US008678019B2

(12) United States Patent
Christie

(10) Patent No.: US 8,678,019 B2
(45) Date of Patent: Mar. 25, 2014

(54) UMBRELLA ENGAGED WITH A BACK PACK

(76) Inventor: Joseph L. Christie, Channelview, TX (US)

( * ) Notice: Subject to any disclaimer, the term of this patent is extended or adjusted under 35 U.S.C. 154(b) by 0 days.

(21) Appl. No.: 13/402,754

(22) Filed: Feb. 22, 2012

(65) Prior Publication Data

US 2013/0213445 A1 Aug. 22, 2013

(51) Int. Cl.
*A45B 3/00* (2006.01)
*A45B 11/00* (2006.01)

(52) U.S. Cl.
USPC ..... 135/16; 135/34.2; 224/154; 224/186; 224/915

(58) Field of Classification Search
USPC ..... 135/16, 20.1, 25.41, 34.2; 224/153–154, 915, 186, 189–190, 224/680–681
See application file for complete search history.

(56) References Cited

U.S. PATENT DOCUMENTS

| | | | | |
|---|---|---|---|---|
| 3,204,650 | A * | 9/1965 | Shinew | 135/16 |
| 5,160,000 | A * | 11/1992 | Agha et al. | 190/102 |
| 5,263,837 | A * | 11/1993 | Dompe | 224/190 |
| 6,024,464 | A * | 2/2000 | De Vera | 362/102 |
| 6,053,385 | A * | 4/2000 | Ward et al. | 224/576 |
| 6,308,722 | B1 * | 10/2001 | Christie | 135/16 |
| 6,471,289 | B2 * | 10/2002 | Aguilar | 297/184.16 |
| 6,866,173 | B2 * | 3/2005 | Haber | 224/160 |
| 6,899,388 | B1 * | 5/2005 | Enrique | 297/184.16 |
| 2004/0232186 | A1 * | 11/2004 | Huang et al. | 224/576 |
| 2011/0147427 | A1 * | 6/2011 | Weaver | 224/576 |

* cited by examiner

*Primary Examiner* — Winnie Yip
(74) *Attorney, Agent, or Firm* — Delphine James

(57) ABSTRACT

The present invention comprises a backpack with an anchoring device. The anchoring device allows an umbrella to be attached to the backpack. The umbrella has a collapsible canopy and can be stored in a storage unit on the backpack.

12 Claims, 8 Drawing Sheets

UMBRELLA ENGAGED WITH A BACK PACK

BACKGROUND OF THE INVENTION

1. Field of the Invention

This invention relates to an umbrella, and more particularly concerns an umbrella which can be supported by a backpack worn by the user.

2. Description of the Prior Art

Umbrellas intended for hand-held use are generally comprised of a collapsible canopy, an elongated shaft that is usually telescopically extendable, and a holding handle disposed at the lower extremity of the shaft. Such umbrellas have long been used by persons desiring to shield themselves from the sun and rain. It is well established that, from a health standpoint, it is desirable to minimize exposure to direct sunlight.

Conventionally, umbrellas are hand carried by the person using the umbrella. Carrying an umbrella, however does not allow the free use of a person's hands to carry packages or the like, or perform other functions. It is therefore desirable to provide an improved umbrella that will allow a person using the umbrella to use their hands without being encumbered by the umbrella.

While umbrellas have heretofore been strapped to the back of a person, they are difficult to attach and the harnesses are clumsy. Further, such harnesses must be detached if the umbrella is to be hand-held, as is conventional. It is therefore desirable to provide an umbrella which can be worn, if desired, but which includes structure which allows the umbrella to be worn or hand-held, as desired, while still being convenient to use and conveniently stored.

Examples of such back-mounted umbrellas are disclosed in U.S. Pat. Nos. D330,455; D345,856; D361,654; 3,892,251 and 4,188,965. In general, such back-mounted umbrellas involve a harness which either secures an umbrella of usual construction having a bottom handle, or secures a specially constructed umbrella having a straight shaft that removably inserts into a holding structure associated with the harness.

A common shortcoming of prior back-mounted umbrellas is that the umbrella tends to rotate within the holding structure, particularly in strong winds. Also, tilting movements in both the path of the person's walking movement and in the lateral or transverse direction are difficult to control. When a specialized harness is employed, it is difficult to emplace and is restrictive, and serves no other useful purpose.

Backpack carrying units are in commonplace use by hikers, campers and school students. The usual backpack is comprised of a storage compartment adapted to be worn on the back and secured by paired shoulder straps and a waist belt.

It is accordingly an object of the present invention to provide an umbrella and backpack combination wherein the backpack provides support for the umbrella.

It is a further object of this invention to provide the combination of the foregoing object wherein the umbrella is easily attached to and removed from the backpack.

It is another object of the present invention to provide the combination of the aforesaid nature wherein the umbrella, in its deployed, open state is stabilized with respect to rotative and tilting movements.

It is yet another object of this invention to provide the combination of the aforesaid nature wherein said backpack contains means for securing said umbrella in its collapsed, storage state.

It is a still further object of the present invention to provide the combination of the aforesaid nature wherein the separate functionality of umbrella and backpack remains unimpaired.

These objects and other objects and advantages of the invention will be apparent from the following description.

SUMMARY OF THE INVENTION

The above and other beneficial objects and advantages are accomplished in accordance with the present invention by an umbrella and backpack combination comprising:

a) an umbrella comprising a collapsible canopy and a straight center shaft interactive with said canopy and extending to a lower handle having a fastener releasably engaged within the tubular receiver mounted within an anchoring structure;

b) a backpack having a storage compartment bounded in part by forward and rearward surfaces, and paired shoulder straps; alternatively a waist strap can be associated with said forward surface, and c) The embodiment further comprises an anchoring structure releasbly engaged within a compartment of the backpack.

BRIEF DESCRIPTION OF THE DRAWING

For a fuller understanding of the nature and, objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figures 1, 1A, 1B, 1C:
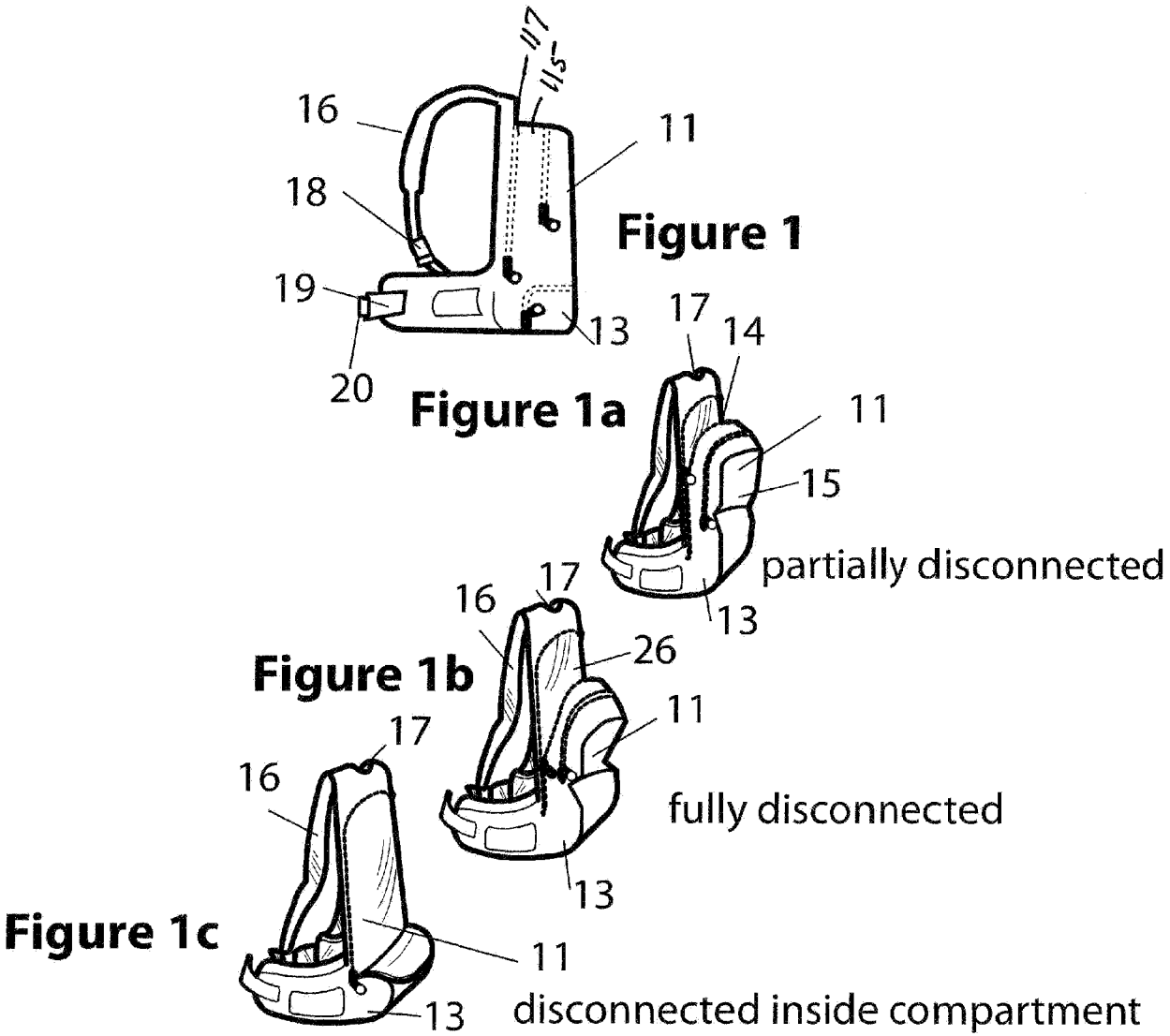
FIG. 1 is a side view of the different compartments of the backpack.
FIG. 1*a* is a side view of the backpack partially disconnected.
FIG. 1*b* is a side view of the backpack fully disconnected.
FIG. 1*c* is a side view of the backpack disconnected and inside the storage compartment.

Referring now to FIGS. 1-9, an embodiment of the umbrella and backpack combination 10 of the present invention is shown comprised of backpack 11 and umbrella 12.

Backpack 11 is of conventional construction, comprised of a storage compartment 115 which can be fabricated of sturdy fabric such as rip-stop nylon or another suitable material, and bounded in part by forward and rearward surfaces 14 and 15, respectively. Paired vertically oriented shoulder straps 16, which can be fabricated from heavy duty fabric belting, are fixably attached to forward surface 14 on adjacent opposite sides. Said shoulder straps (16) are usually equipped with adjusting mechanism 18 which can be conventional buckles. For insertion of items into compartment 115 a fastening element (116) extends across the median of compartment 115.

In an alternative embodiment, a horizontally oriented waist strap 19 can be also associated with forward surface 14, and equipped with an adjustment mechanism 20 which can be conventional buckle.

Referring to FIGS. 1-1*c*, while not in use the storage compartment 115 of back pack 11 can be stored as shown. As depicted, the forward surface 14 of backpack 11 is detachable by way of fasteners such as a zipper (116). Once disconnected, the backpack 11 compartment 115 can be is rolled down for storage and, held in place with fasteners such as Velcro (50) as depicted as depicted in FIG. 1*c*.

Figures 2, 2A, 2B:
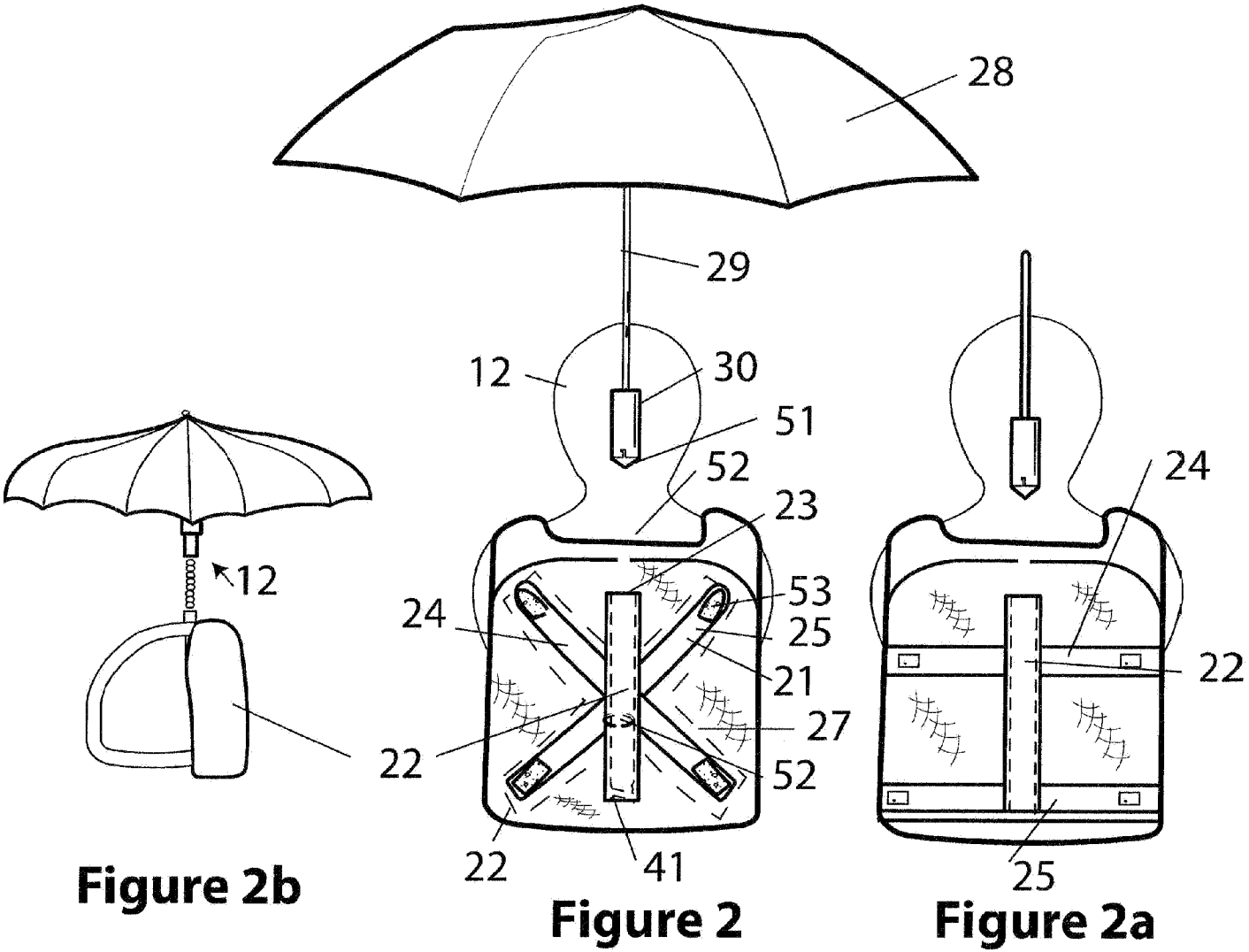
FIG. 2 is a frontal view of the stabilizing unit with the diagonal anchor.
FIG. 2*a* is a frontal view of the stabilizing unit with the horizontal anchor.
FIG. 2*b* is a side view of device.
Figure 3B:
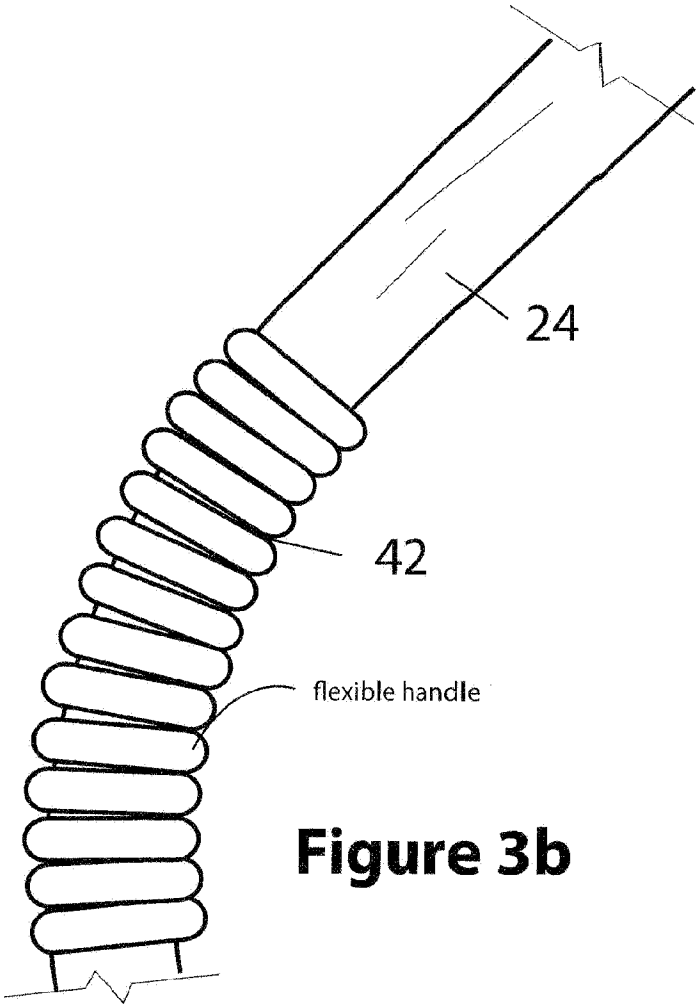
FIG. 3*b* is a cutaway view of the flexible handle.
Figure 3A:
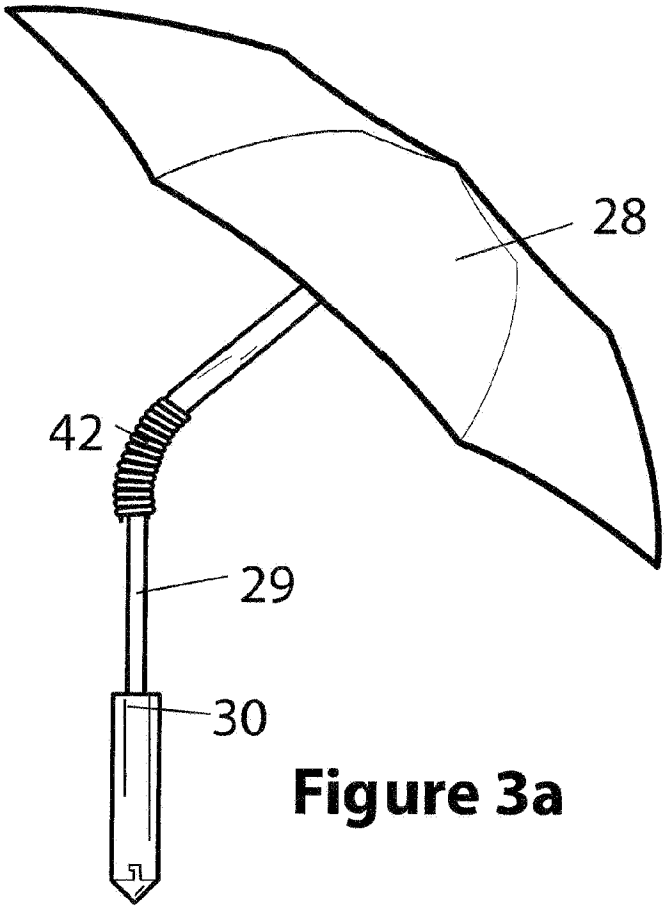
FIG. 3*a* is a cutaway view of the umbrella.
Figure 5:
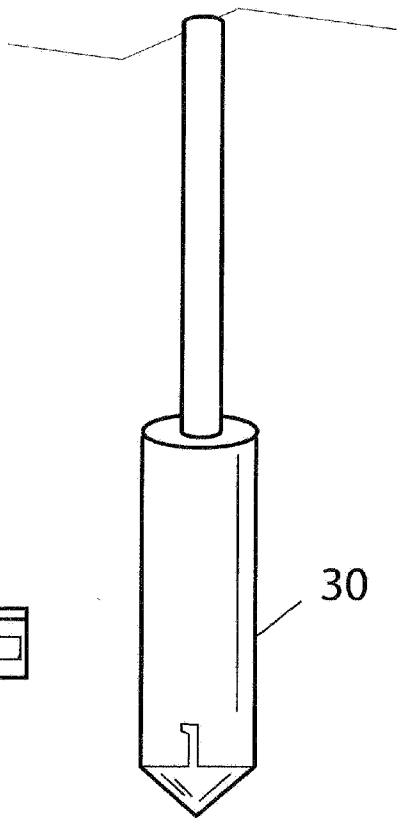
FIG. 5 is a cutaway view of the handle.
Figure 4A:
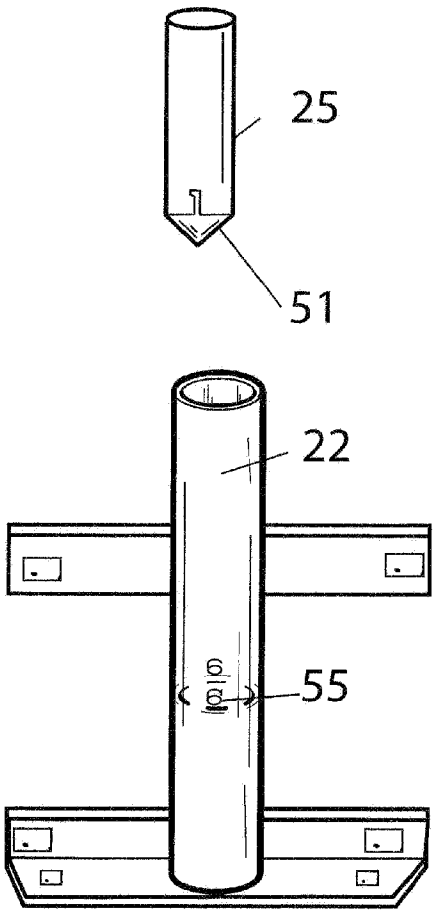
FIG. 4*a* is a cutaway view of the stabilizing unit with the horizontal anchor.
Figure 4:
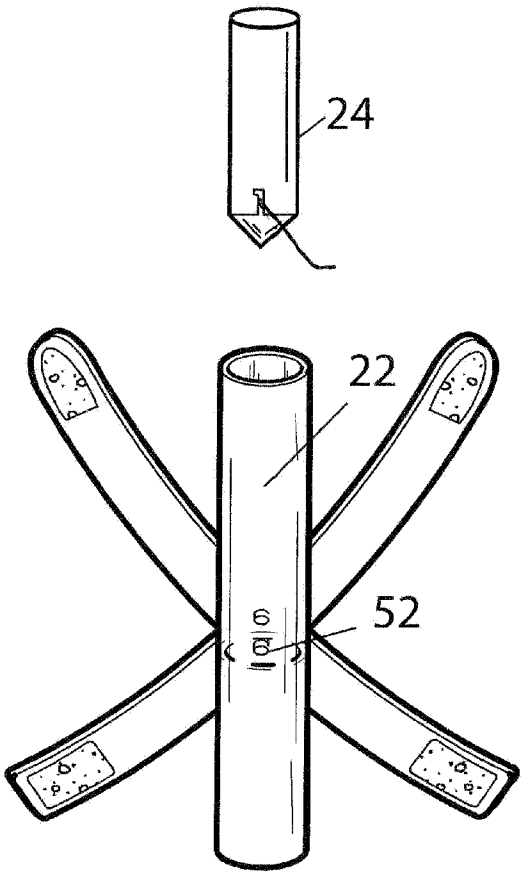
FIG. 4 is a cutaway view of the stabilizing unit with the diagonal anchor.
Figures 5A, 5B, 5C, 5D, 5E:
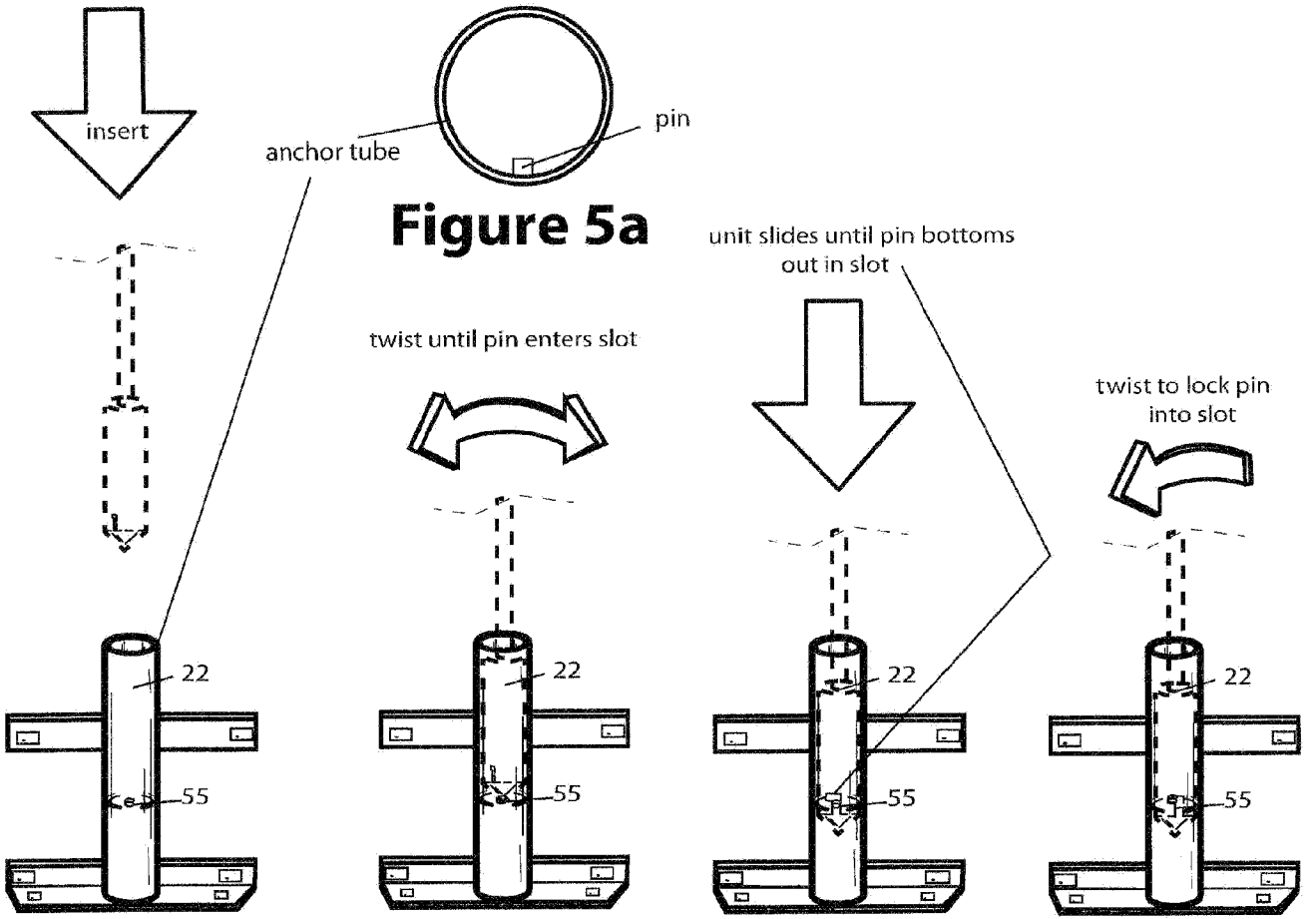

Referring FIGS. 2-2*a* and FIGS. 7-7*a*, umbrella holding mechanism in the form of anchoring structure 21 is shown. Anchoring structure 21 is comprised of a vertically disposed tubular receiver 22 having an open upper extremity 23 and a lower portion (41). Within the cavity of receiver 22 is a male fastener 52 disposed above the lower portion (41). The lower portion 41 of said receiver is preferably flattened so as to minimize space occupied within the backpack 11. In the preferred embodiment, at least one horizontally disposed stabilizing means in the form of elongated bar 24 is attached to receiver 22. In another embodiment as shown in FIG. 2, an elongated bar (24) can be oriented diagonally and extends towards the four corners of the storage compartment 115. In the illustrated preferred embodiment, a second elongated bar 25 can be disposed upon receiver 22 above elongated bar 24. Said stabilizing bars (24, 25) may be in two halves extending from opposite sides of receiver 22 in coplanar relationship therewith.

Figure 6:
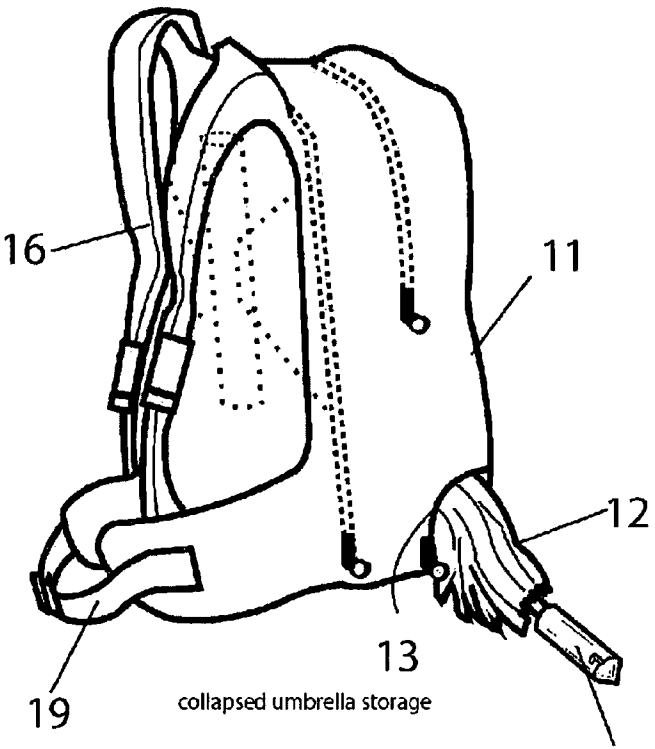
FIG. 6 is side view of the umbrella in the storage unit.
Figure 6A:
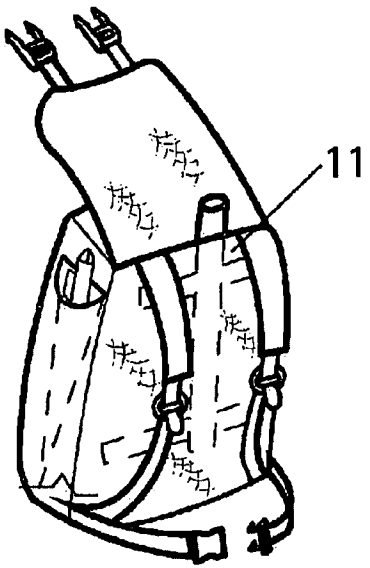
FIG. 6*a* is a side view of the anchor within a conventional backpack.

In one embodiment, anchoring structure 21 can be removably inserted into a special compartment located within facing panel 26 in front of forward surface 14. Other means may, however be employed to secure said anchoring structure to said backpack. Alternatively, anchoring structure 21 can be inserted within a storage compartment 115 of a conventional back pack 11. To be secured in place each elongated bar (24, 25) can extend the length of the compartment (115, 116). In use, the fastener along the median of storage compartment 115 is detached and anchoring structure 21 is placed within storage compartment 115. To securely hold anchoring structure 21 in place fasteners are closed on opposing sides of anchoring structure 21 as shown in FIGS. 6 and 6*a*.

Figure 6B:
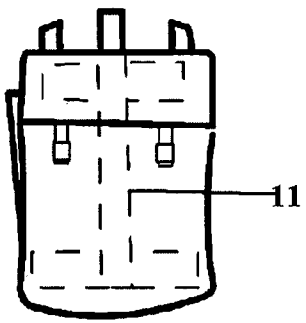
FIG. 6*b* is a frontal view of the anchor within a conventional backpack.

In an alternative embodiment, as shown in FIGS. 2-2*a* the anchoring structure 21 is detachable from the backpack by way of attaching elements 53 such as Velcro located at the lower end of each stabilizing bar (24, 25). This allows the anchoring structure 21 to be placed in a conventional backpack as depicted in FIG. 6*a*-6*b*. Anchoring structure 21 may be fabricated of lightweight metal such as aluminum, or may be fabricated of plastic, in which case it may be a monolithic structure produced by way of a molding operation.

Umbrella 12 is comprised of collapsible canopy 28 and a straight center shaft 29 interactive in conventional manner with said canopy. Shaft 29, preferably of telescopically extendable tubular construction, extends to a lower terminal handle 30 equipped with male fastener 51 that inter locks into the female fastener 52 located within the cavity of receiver 22. Alternatively, as shown in FIG. 2*a*, handle 30 can be equipped with a removable sleeve 151 that incorporates the male fasteners 51.

As shown, locking mechanism comprises female fastener 51 and male fastener 52. Female fastener 51 can be fabricated as a recessed portion incorporated within handle 30 or removable sleeve 130. Mating male fastener 52 can be fabricated as a locking pin or a spline with receiving slots which securely engaged within recessed portion. Alternatively, locking mechanism can comprise an internal padding within the cavity which securely engages with handle 30 of the umbrella shaft 29 wherein umbrella 12 is held in place. Locking mechanism can be manufactured by way of other means.

A push-button control 34 on shaft 29 causes the canopy 55 of the umbrella to move vertically upward or downward. The umbrella, in its collapsed storage state may have a length of between about 10 and 14 inches. In FIG. 6, the collapsed umbrella can be stored in a storage compartment 54. In the alternative embodiment referring to FIG. 9, shaft 29 has a flexible member 42 incorporated and disposed near the middle of the shaft allowing the canopy to bend in various ways.

Figure 7A:
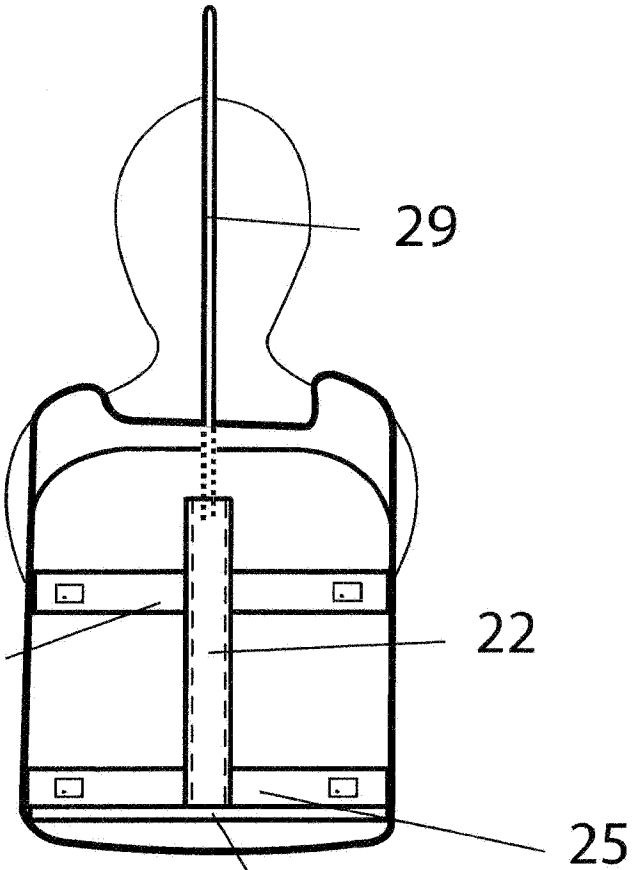
FIG. 7*a* is frontal view of the handle within the receiver with the horizontal anchor.
Figure 7:
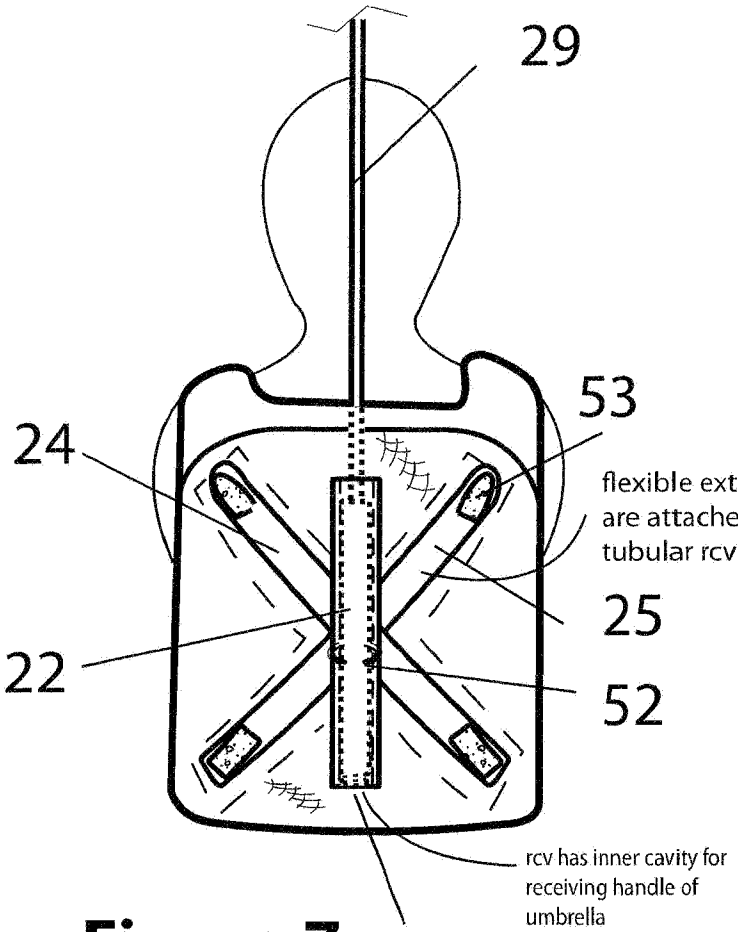
FIG. 7 is a frontal view of the handle within the receiver with the diagonal anchor.
Figure 9:
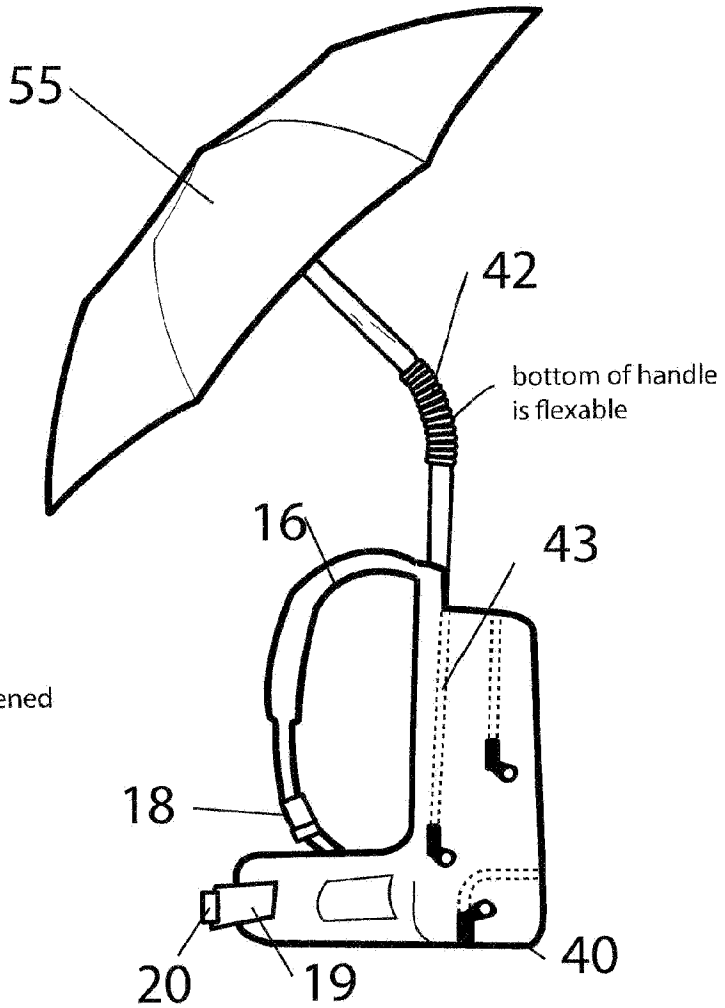
FIG. 9 is a side view of the device with the flexible handle.
Figure 8:
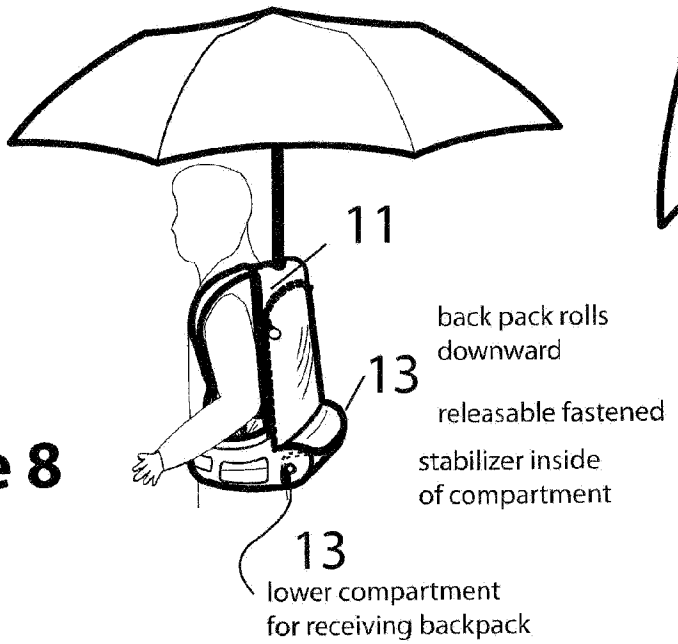
FIG. 8 is a perspective view of the backpack.

When shaft 29 is inserted into receiver 22, the user pushes downward as shown in FIGS. 7-7*a*, the umbrella is sufficiently secure so as to resist rotative movement about the shaft axis, and to resist tilting movement in any direction away from verticality. A hand grip 38 is preferably associated with shaft 29 adjacent said terminal extremity 30. Said hand grip facilitates the use of the umbrella in a conventional hand-held manner detached from the backpack.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. An anchoring device in combination with a backpack and an umbrella, the device comprising:

the umbrella having a canopy fixably mounted upon a top end of an umbrella shaft that extends downward to a handle;

the backpack having an inner compartment with an upper opening;

the anchoring device comprising a stabilizing unit comprising a tubular receiver centrally mounted within a supporting structure having a surface area that extends the inner compartment of the backpack and that is detached therewith;

the supporting structure being removably insertable into the inner compartment through the upper opening;

the tubular receiver defined by an upper portion formed upon and disposed above a lower portion;

the upper portion of the tubular receiver having a cavity extending downward to above the lower portion which extends downward to a predetermined length;

the upper portion configured to receive the handle therein an attaching element operationally mounted with the cavity above the lower portion;

the handle configure to removably and securely engage with the attaching element as the handle of the umbrella shaft is inserted into the cavity of the tubular receiver wherein the umbrella is held in place.

2. The device of claim 1 further comprising:

the inner compartment of the backpack defined by a forward and a rearward surface;

a fastener attached to the upper opening for opening and closing the inner compartment;

the stabilizing unit being removably inserted through the upper opening of the inner compartment with the upper portion extending vertically and linearly upward through an opening disposed thereon.

3. The device of claim 2 wherein further comprising:

the backpack having a second compartment disposed in front of the forward surface; and the stabilizing unit being removably inserted within the inner compartment with the upper portion extending vertically and linearly upward through the upper opening.

4. The device of claim 2 wherein the supporting structure further comprises detachable attaching elements incorporated thereon wherein the stabilizing unit is removable attached from the inner compartment.

5. The device of claim 2 wherein the backpack further comprises:

a facing panel extending the surface area of the inner compartment the forward surface being detachable therefrom wherein the facing panel is formed;

a fastener mechanism attached to a lower end of the facing panel wherein the compartment can be secured thereto.

6. The device of claim 1 wherein the umbrella shaft further comprises a lower section that is made of a flexible material wherein the umbrella shaft can be placed in various positions.

7. The device of claim 6, wherein the lower section further comprises a sleeve that removably encompasses thereon.

8. The device of claim 1 wherein the supporting structure further comprises:

a plurality of elongated bars extending outward therefrom to a predetermined length.

9. The device of claim 8 wherein the plurality of elongated bars further comprises a distal end with a fastening mechanism securely attached thereon.

10. The device of claim 1 wherein the lower portion is flattened and extending linearly downward from the upper portion to a predetermined length.

11. The device of claim 1 wherein a locking mechanism is removably and operationally mounted upon the handle.

12. A method utilizing an anchoring device using in combination an umbrella and backpack having a storage compartment, the method comprising steps of:

providing the anchoring device in claim 1;

detaching the opening opening the inn storage compartment of the backpack;

placing the stabilizer unit within the inner compartment through the opening with the tubular receiver extending upward through the opening of the inner compartment;

placing the umbrella shaft into the cavity of the tubular receiver;

securely engaging the locking mechanism handle with the attaching element wherein the umbrella is held in place; and and closing the storage compartment wherein the stabilizing unit is held in place within the storage compartment.

* * * * *